United States Patent [19]

Schwab

[11] Patent Number: 4,964,549

[45] Date of Patent: Oct. 23, 1990

[54] TWO PIECE TORSO DISPLAY DEVICE FOR STOCKINGS

[76] Inventor: Kerstein Schwab, Gwand la, 7245 Starzach, Fed. Rep. of Germany

[21] Appl. No.: 330,437

[22] Filed: Mar. 30, 1989

[30] Foreign Application Priority Data

Apr. 1, 1988 [DE] Fed. Rep. of Germany ..... 8804402

[51] Int. Cl.[5] ..... A47F 7/19; A47F 7/10; A47F 7/00; A47F 8/00

[52] U.S. Cl. ..... 223/66; 223/75; 223/84; 223/120; 223/71

[58] Field of Search ..... 223/75, 66, 60, 76, 223/77, 61, 71, 120; 206/278, 493

[56] References Cited

U.S. PATENT DOCUMENTS

| | | | |
|---|---|---|---|
| 856,004 | 6/1907 | Traviss | 223/71 |
| 1,021,108 | 3/1912 | McHattie & Lyle | 223/68 |
| 1,574,335 | 2/1926 | Allen . | |
| 2,082,135 | 3/1935 | Allan | 223/68 |
| 2,180,402 | 11/1939 | DeWitt | 223/75 |
| 2,285,064 | 6/1942 | Straw | 223/68 |
| 2,468,476 | 4/1949 | Wiken | 223/66 |
| 2,520,975 | 4/1947 | Springer | 223/66 |
| 3,044,671 | 7/1962 | Strumpf | 223/66 |
| 3,082,920 | 3/1963 | Stein | 223/67 |
| 3,168,227 | 2/1965 | Osmond | 223/66 |
| 3,246,422 | 4/1966 | Teagarden | 223/66 |

FOREIGN PATENT DOCUMENTS

| | | | |
|---|---|---|---|
| 485712 | 11/1929 | Fed. Rep. of Germany . | |
| 825344 | 12/1951 | Fed. Rep. of Germany . | |
| 1251331 | 12/1960 | France | 223/66 |
| 162450 | 5/1921 | United Kingdom | 223/75 |

*Primary Examiner*—Werner H. Schroeder
*Assistant Examiner*—Bibhu Mohanty
*Attorney, Agent, or Firm*—Marmorek, Guttman & Rubenstein

[57] ABSTRACT

A device for displaying panty hose comprises a hollow body formed from front and back portions joined together. The front and back portions include outer surfaces contoured to simulate a human trunk and abdomen. The hollow body is somewhat flattened so that the distance between the outer surfaces of the front and back portions is less than the depth of a human trunk and abdomen. Desirably, the body includes flattened areas at its bottom resembling truncated legs. A mounting stand is formed as a basin-like bowl with a hollow into which the flattened areas of the body fit. The mounting stand also includes pockets for receiving the legs of a pair of panty hose.

10 Claims, 1 Drawing Sheet

FIG. 1
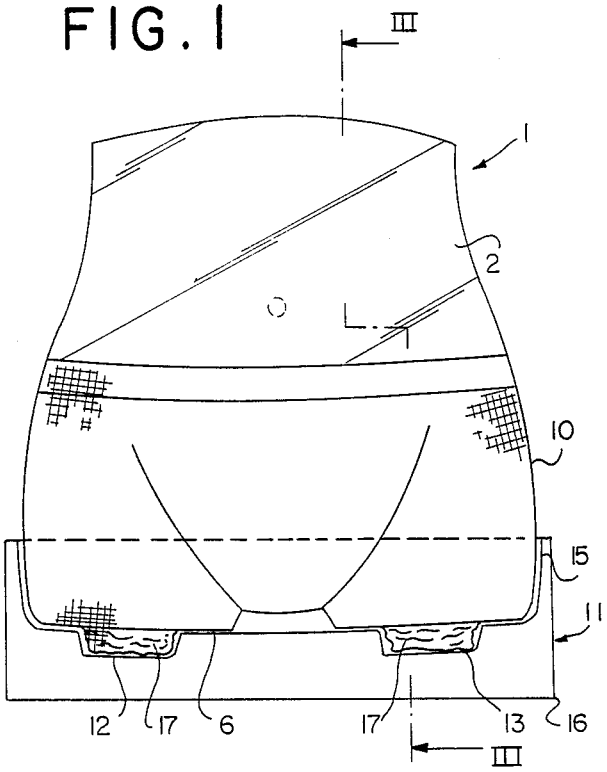
FIG. 3
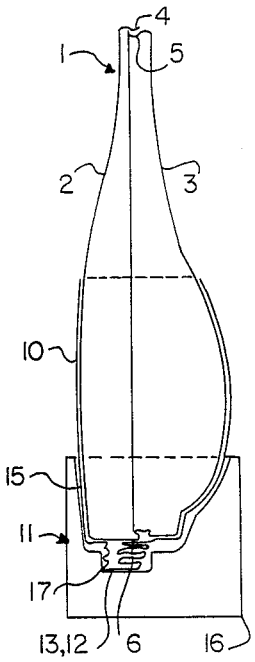
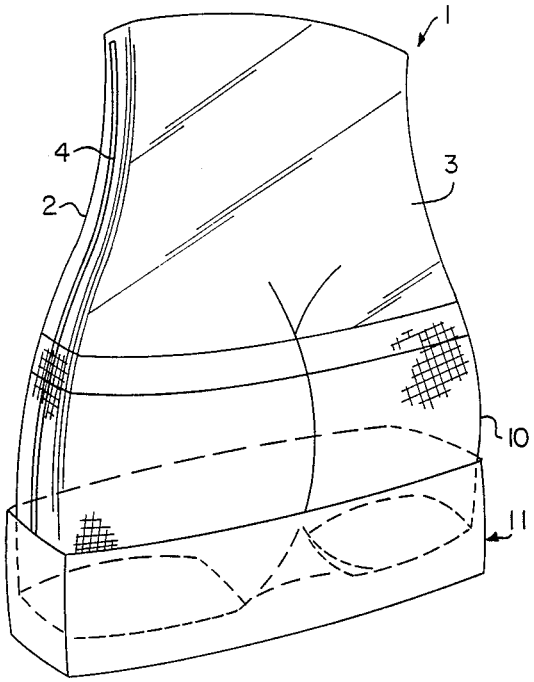
FIG. 2

TWO PIECE TORSO DISPLAY DEVICE FOR STOCKINGS

Background of the Invention

The invention relates to a display device for panty hose.

Panty hose can be displayed by putting it on appropriate mannequins. However, this is very troublesome and expensive. This type of display of panty hose cannot be used to show a great number of different models and designs in a store. In most cases panty hose is sold packaged, and in such cases the buyer must rely on the picture on the package. However, this does not properly represent how special types of panty hose will look when worn, in particular where the panties are woven or knit into the garment.

It is therefore an object of the invention to create an improved display device for panty hose.

Summary of the Invention

According to the present invention, this object is attained by means of a hollow body made in the form of an abdomen and trunk which body is however flattened with respect to the distance between the front and the back.

This trunk-like hollow body, made to resemble an abdomen on its front and back, can thus be "dressed" in panty hose. The legs of the panty hose can be placed advantageously into pockets made to receive the hose legs provided in a mounting stand surrounding the lower part of the abdomen. In this way a great number of units can be easily handled and displayed, through which the design characteristics of a panty hose can be shown off to best advantage.

Brief Description of the Drawings

An embodiment of the invention and of its advantageous further developments are described hereinafter through the attached drawings in which:

FIG. 1 shows a front view of the inventive display device, with a mounting stand surrounding the lower part of a hollow body shown cut off;

FIG. 2 shows a perspective view of the inventive display device, seen from behind; and FIG. 3 shows a section along line III—III of FIG. 1.

Detailed Description

The inventive display device is made in form of a hollow body 1. The hollow body 1 comprises two parts, a frontal element 2 and a back element 3 which are snapped together and thus constitute the whole hollow body 1 having the truncated form of a female abdomen. The distance between the front and the back is however flattened, i.e., it is smaller than would be the case in an actual model. The front 2 and the back 3 are provided with slip folds 4, 5 along sections of their peripheries which fit into each other in the manner of a groove and spring connection so that both elements can be assembled in this manner into one whole hollow body 1. The hollow body 1, as can be seen in particular in FIG. 3, is provided with flattened areas 6 at the bottom to correspond to the beginnings of the upper thigh and resembling truncated legs.

The lower part of the hollow body 1 is surrounded by the edge 15 of a mounting stand 11. The latter is made in form of a bowl which holds the hollow body 1. The mounting stand 11 is a molded plastic part open at the bottom which stands with its lower edge 16 on a support. The bowl-like inner hollow of the mounting stand 11 is adapted to the form of the lower part of the hollow body I and is provided with two pockets 12, 13 to hold hose legs 17.

Panty hose can be displayed by being put on the hollow body 1. The legs 17 of the panty hose 10 are held in the pockets 12, 13 of the mounting stand 11 made to hold the hose legs.

While the invention has been described by reference to a specific embodiment, this was for purposes of illustration only. Numerous alternative embodiments are also possible and are within the scope of the contemplated invention.

I claim:

1. A device for displaying panty hose, comprising a hollow body comprising front and back portions having outer surfaces contoured to simulate a human trunk and abdomen for being fitted with a pair of panty hose, each of said front and back portions also including peripheral edge portions which meet and form sides of said device, said sides being of reduced dimension relative to a human body so that the distance between the outer surfaces of said front and back portions is less than the depth of a human trunk and abdomen.

2. The device of claim 1 wherein said body includes flat lower surface areas.

3. The device of claim 1 further comprising means for releasably joining said front and back portions together.

4. The device of claim 3 wherein said means comprises slip folds.

5. The device of claim 1 wherein said body is made from molded plastic.

6. The device of claim 1 further comprising a mounting stand configured to receive a lower portion of said body.

7. The device of claim 6 wherein said mounting stand includes a bowl-like basin configured to closely receive said lower portion of said body.

8. The device of claim 7 wherein said mounting stand includes pockets to receive the legs of a pair of panty hose, said pockets being disposed opposite flat lower surface areas of said body.

9. The device of claim 8 wherein said mounting stand is made from molded plastic and includes a standing edge.

10. The device of claim 1 wherein said sides are flattened.

* * * * *